US006915552B2

(12) United States Patent
Blankenship

(10) Patent No.: US 6,915,552 B2
(45) Date of Patent: Jul. 12, 2005

(54) PORCELAIN OVEN RACK

(75) Inventor: David J. Blankenship, Morristown, TN (US)

(73) Assignee: SSW Holdings Company, Inc., Fort Smith, AR (US)

( * ) Notice: Subject to any disclaimer, the term of this patent is extended or adjusted under 35 U.S.C. 154(b) by 0 days.

(21) Appl. No.: 10/384,587

(22) Filed: Mar. 11, 2003

(65) Prior Publication Data

US 2003/0175516 A1 Sep. 18, 2003

Related U.S. Application Data

(63) Continuation of application No. 10/260,487, filed on Sep. 30, 2002, now Pat. No. 6,837,235.

(60) Provisional application No. 60/368,501, filed on Mar. 28, 2002, and provisional application No. 60/364,308, filed on Mar. 14, 2002.

(51) Int. Cl.[7] ..... B23P 19/04

(52) U.S. Cl. ..... 29/460; 29/458; 29/452; 29/897.15; 312/410

(58) Field of Search ..... 29/460, 452, 458, 29/448, 469.5, 897.15; 126/214 C, 337 R; 427/458, 475; 211/181.1; 312/410

(56) References Cited

U.S. PATENT DOCUMENTS 1,896,307 A * 2/1933 Hatch ..... 312/408
2,633,400 A * 3/1953 Ring ..... 312/410
4,194,495 A * 3/1980 Scherer ..... 126/339
5,651,597 A * 7/1997 Oslin ..... 312/350

* cited by examiner

*Primary Examiner*—David P. Bryant
*Assistant Examiner*—Stephen Kenny

(74) *Attorney, Agent, or Firm*—Marshall, Gerstein & Borun LLP

(57) ABSTRACT

A porcelain coated steel wire oven rack. The preferred coated steel wire oven rack includes a plurality of elongated steel wire members joined together to form an oven rack having an outer surface. The plurality of elongated steel wire members are made from a steel rod material containing from about 80 to about 99.9% by weight of iron, from about 0.001 to about 0.08% by weight of carbon and from about 0.001 to about 0.2% by weight of a carbon stabilizing transition metal, preferably selected from the group consisting of Vanadium, Tantalum, Titanium and Niobium. The plurality of elongated steel wire members are preferably made from the steel rod material by drawing the steel rod material to form steel wire; wherein the diameter of the cross-sectional area of the steel rod material is reduced by at least about 20% when the steel rod material is drawn to form the steel wire to prevent chipping of the glass material from the outer surface due to the release of hydrogen gas from the steel wire members when the steel wire is heated above 900° F.

11 Claims, 3 Drawing Sheets

10"
12"

20"
22"
15"
17"

14"
20"

9
9
16"
12"
10"

PORCELAIN OVEN RACK

CROSS-REFERENCE TO RELATED APPLICATION

This application is a continuation of application Ser. No. 10/260,487 filed Sep. 30, 2002, now U.S. Pat. No. 6,837,235 which claims the benefit of provisional applications Ser. No. 60/368,501, filed Mar. 28, 2002, and Ser. No. 60/364,308, filed Mar. 14, 2002.

FIELD OF THE INVENTION

The present invention relates to steel wire products coated with glass material to protect the steel wire products from discoloration and the like due to heating the steel wire products at high temperatures. These steel wire products are preferably oven racks coated with porcelain to provide suitable oven rack surfaces for cooking, which do not discolor during cooking, or during self-cleaning cycles when the oven racks remain in the oven and the temperatures generally exceed the normal cooking temperatures.

BACKGROUND OF THE INVENTION

Steel wire oven racks made from steel rod drawn to form steel wire are well-known in the industry. Such steel wire oven racks, however, are generally discolored when they are subjected to the high temperatures above 900 degrees F. associated with self-cleaning oven cycles which are common in today's kitchen ovens. It will be appreciated that improvements to address this discoloration problem and to increase color flexibility will be positive additions to the useful arts. The present invention provides such an improvement. It will be appreciated, therefore, that further improvements in oven racks and methods for making oven racks are needed to address problems such as this.

The present invention provides solutions to this and other problems associated with oven racks for ovens sold into consumer markets and otherwise.

SUMMARY OF THE INVENTION

The present invention provides a coated steel wire oven rack designed to be -received within an oven cavity. The coated steel wire oven rack includes a plurality of elongated steel wire members joined together to form an oven rack having an outer surface; wherein the cross-sectional area of the steel rod material is reduced by at least about 20% when the steel rod material is drawn to form the steel wire; the outer surface of the oven rack being coated by a glass material, the glass material preferably being porcelain, wherein the amount of carbon in the steel rod material, the amount of carbon stabilizing transition metal in the steel rod material and the degree to which the cross-sectional area of the steel rod material is reduced, when the steel wire is drawn from the steel rod material is balanced so as to prevent chipping of the glass material away from the outer surface due to the release of hydrogen gas from the steel wire members when the steel wire is either heated or cooled.

In preferred embodiments, the glass material, preferably porcelain, is coated onto the steel wire in two distinct coating steps.

In a preferred embodiment, the coated steel wire oven rack is designed to be received with an oven cavity. The coated steel wire oven rack includes a plurality of elongated steel wire members joined together to form an oven rack having an outer surface. The plurality of elongated steel wire members are made from a steel rod material containing from about 80 to about 99.9% by weight of iron, from about 0.001 to about 0.08% by weight of carbon, and from about 0.001 to about 0.2% by weight of a carbon stabilizing transition metal selected from the group consisting of Vanadium, Tantalum, Titanium and Niobium. The plurality of elongated steel wire members are made from the steel rod material by drawing the steel rod material to form steel wire; wherein the cross-sectional area of the steel rod material is reduced by at least about 20% when the steel rod material is drawn to form the steel wire. The outer surface of the oven rack is coated by a glass material, preferably porcelain, wherein the amount of carbon in the steel rod material, the amount of carbon stabilizing transition metal in the steel rod material and the degree to which the cross-sectional area of the steel rod material is reduced when the steel wire is drawn from the steel rod material is balanced so as to prevent chipping of the porcelain away from the outer surface due to the release of hydrogen gas from the steel wire material when the steel wire material is either heated or cooled; wherein the porcelain is coated onto the steel in two distinct coating steps wherein the porcelain is coated onto the steel wire in two distinct electrostatic coating processes followed by a single heating process in which the temperature is preferably raised to about 1550° F. In alternate embodiments, the heating process may be repeated and in yet other alternate embodiments, a wet coating process can be used.

The plurality of elongated steel wire members are made from steel rod material containing from about 80 to about 99.9% by weight of iron, from about 0.001 to about 0.08% by weight of carbon and from about 0.001 to about 0.2% by weight of a transition metal which will have a stabilizing effect on the carbon in the elongated steel wire members such that the carbon absorbs less hydrogen gas when the steel wire member is heated to temperatures above 500° F. than it would in the absence of the carbon stabilizing transition metal. In preferred embodiments, the transition metal is selected from the group consisting of Vanadium, Tantalum, Titanium and Niobium, and in the most preferred embodiment, the transition metal is Vanadium. The plurality of elongated steel wire members are preferably made from steel rod material by a process of area reduction. In the preferred process, the steel rod is pulled through a cold die that gradually reduces in diameter so that the rod is drawn repeatedly through the die and the cross-sectional area of the rod is reduced to form a steel wire having a cross-sectional area of diminished diameter. In preferred embodiments, the diameter of the steel wire is diminished at least about 20%, preferably at least about 30%, more preferably at least about 40%, even more preferably at least about 45%, and most preferably at least about 50%. It will be appreciated that the area reduction creates voids in the steel wire which are desirable to provide cavities into which hydrogen gas can release and, perhaps, compress, without creating pressure to be released from the surface of the steel wire once the steel wire is coated with porcelain. It will be appreciated, that the area reduction, which creates cavities in the steel wire, and the inclusion of carbon stabilizing transition metal elements which reduce the degree to which the carbon in the steel absorbs hydrogen, will diminish the degree to which hydrogen gas out-gassing causes cracking and chipping of the porcelain surface of the elongated steel wire members of the oven rack which are coated by the glass material.

The above-described features and advantages along with various advantages and features of novelty are pointed out with particularity in the claims of the present invention which are annexed hereto and form a further part hereof. However, for a better understanding of the invention, its advantages and objects attained by its use, reference should be made to the drawings which form a further part hereof and to the accompanying descriptive matter in which there is illustrated and described preferred embodiments of the preferred invention.

BRIEF DESCRIPTION OF DRAWINGS

Referring to the drawings, where like numerals refer to like parts throughout the several views.

DETAILED DESCRIPTION OF THE PREFERRED EMBODIMENT

Figures 1, 2, 3:
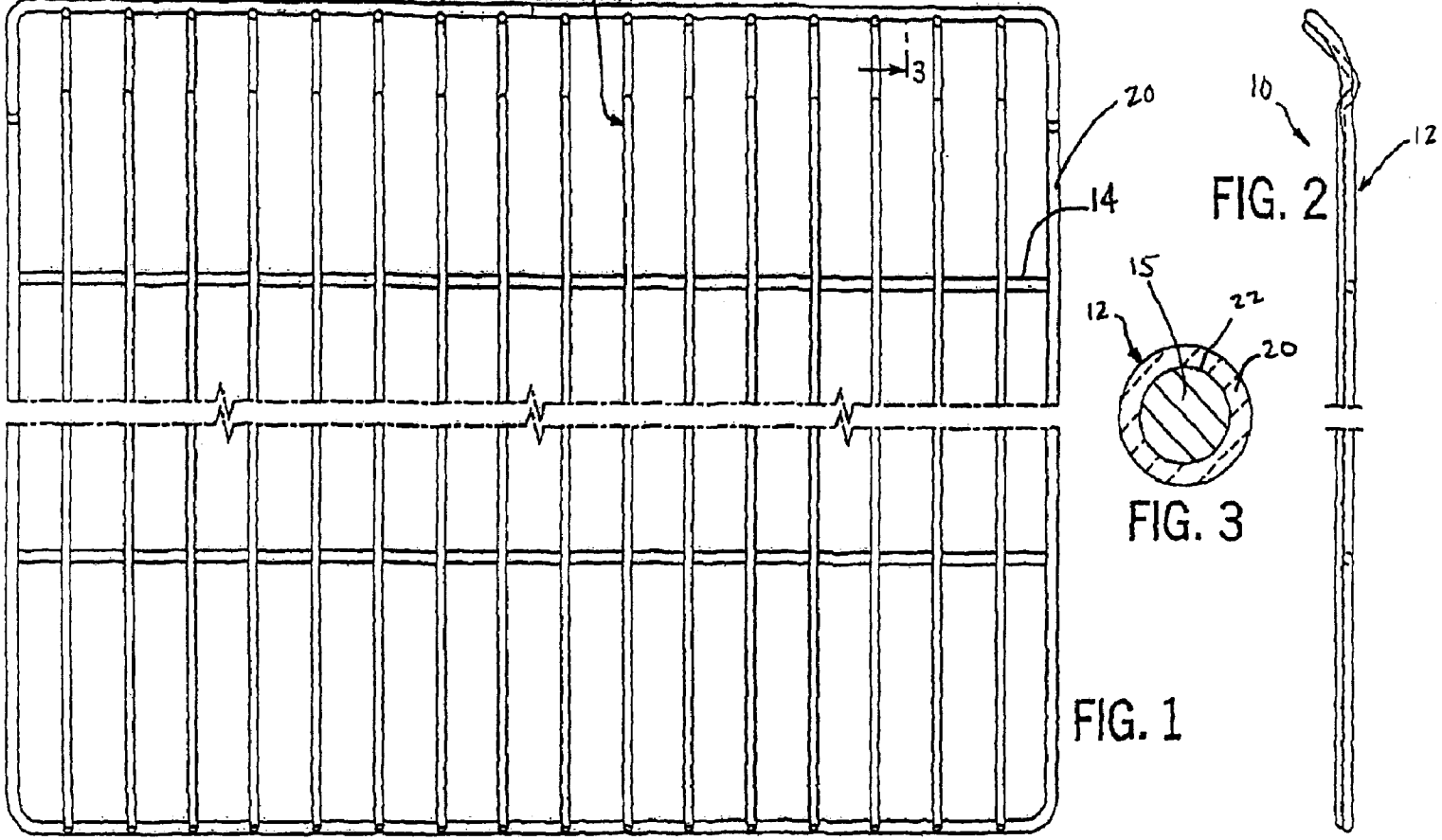
FIG. 1 is a plan view of a coated oven rack in accord with the present invention.
FIG. 2 is a side view of the oven rack shown in FIG. 1.
FIG. 3 is a cross-sectional view of an outside framing wire 12 as seen from the line 3—3 of FIG. 1.

Referring now to the drawings, and in particular FIGS. 1–3, a coated steel wire oven rack 10 is shown. The coated steel oven wire rack 10 has an outside framing wire 12 stabilized by two frame stabilizing support wires 14 and a series of upper surface steel wire members 16 which generally run front to back to provide a support surface for oven utensils (not shown) that are placed on the coated oven rack 10.

Figure 5:
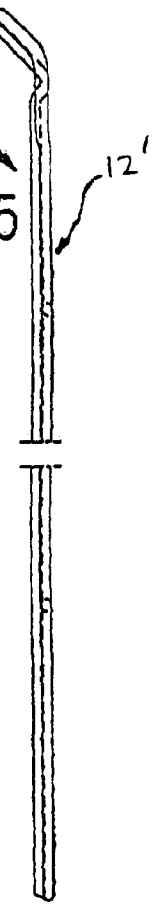
FIG. 5 is a side view of the alternate oven rack shown in FIG. 4.
Figure 6:
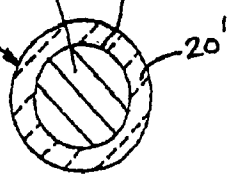
FIG. 6 is a cross-sectional view of an outside framing wire 12' as seen from the line 6—6 of FIG. 4.
Figure 4:
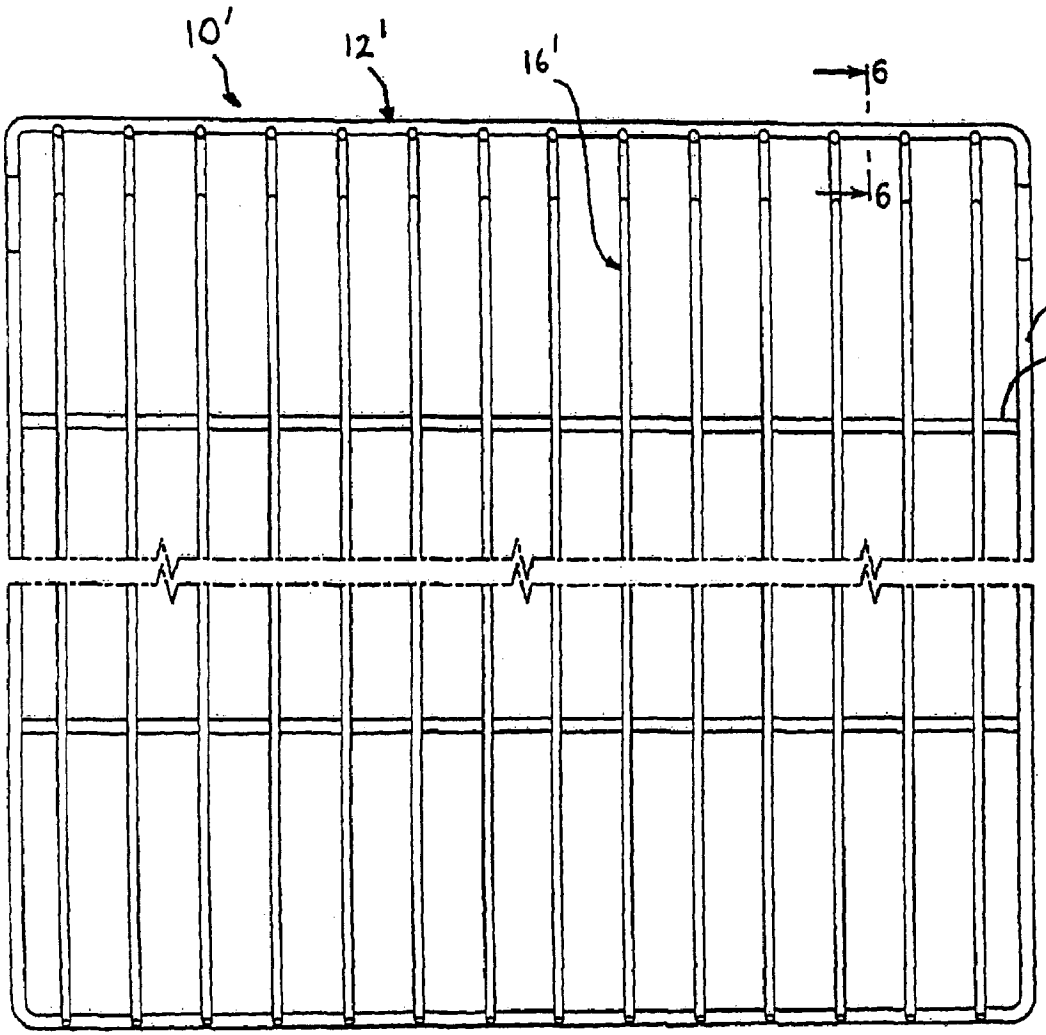
FIG. 4 is a plan view of an alternate oven rack in accord with the present invention.

Referring now also to FIGS. 4–6, an alternate oven rack 10' in accord with the present invention is shown that has only minor differences from the oven rack shown in FIGS. 1–3.

Figures 7, 8, 9:
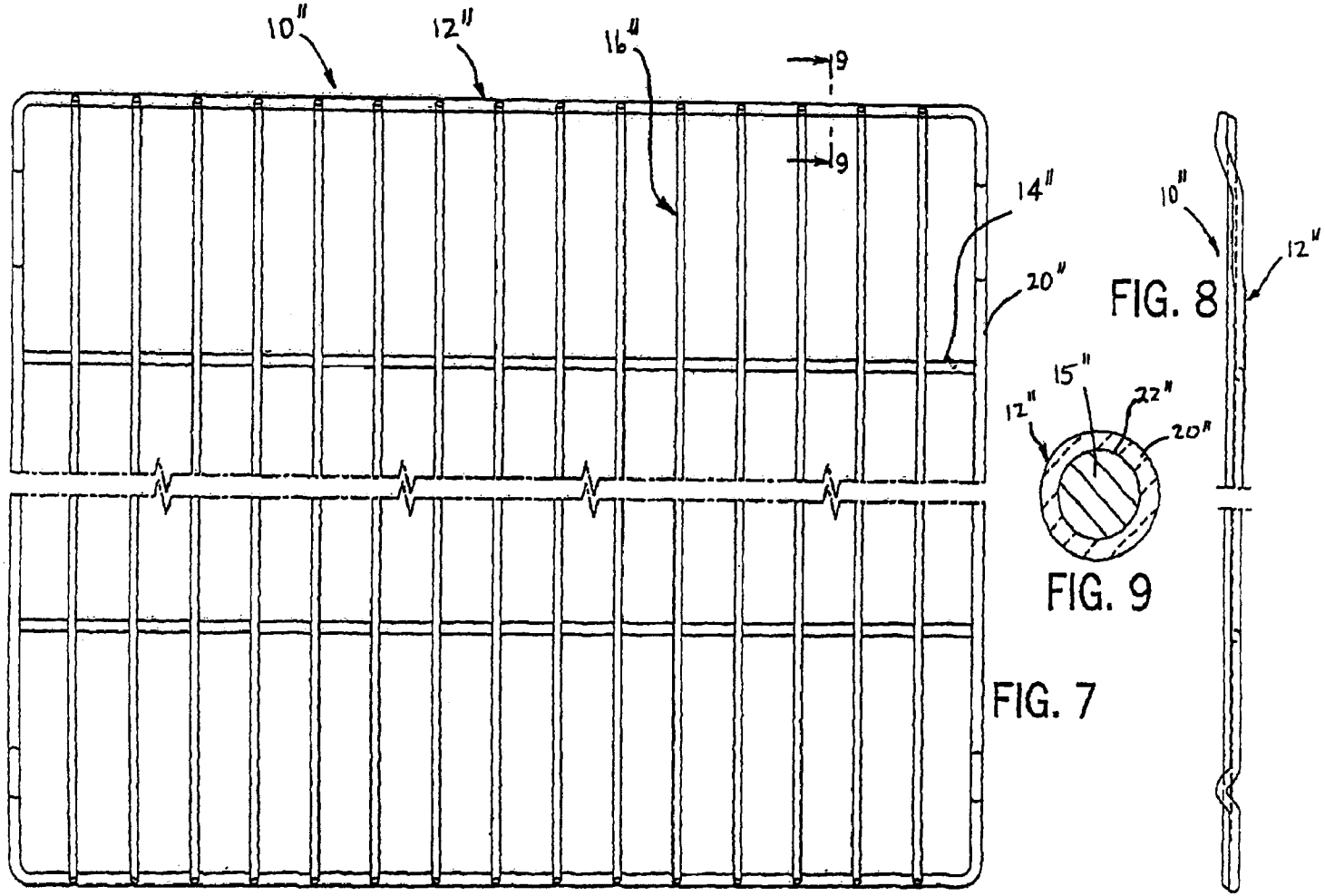
FIG. 7 is a plan view of a further alternate oven rack in accord with the present invention.
FIG. 8 is a side view of the oven rack shown in FIG. 7.
FIG. 9 is a cross-sectional view of an outside framing wire 12' as seen from the line 9—9 of FIG. 7.

Referring now also to FIGS. 7–9, a further alternate oven rack 10' in accord with the present invention is shown, having a few other minor differences, but in most other ways being virtually the same as the oven racks shown in FIGS. 1–6.

The present oven rack 10 is coated with a glass material 20, preferably porcelain, which is coated onto the outer surface 22 of welded steel wire parts 15 of the coated oven rack 10, in a process which generally follows these steps. Steel rod material (not shown) is preferably purchased, which is made primarily of iron but includes the elemental composition shown on the following page.

PORCELAIN WIRE SUBSTRATE B SPECIFICATIONS

| | 0.259 Diam. | 0.192 Diam. | 0.239 Diam. |
|---|---|---|---|
| Rod Size | 5/16 | 9/32 | 5/16 |
| Area Reduction | 31% | 53% | 41.50% |

-continued

PORCELAIN WIRE SUBSTRATE B SPECIFICATIONS

| | Substrate B | | |
|---|---|---|---|
| Chemistry | 0.259 Diam. | 0.192 Diam. | 0.239 Diam. |
| Carbon | 0.046% | 0.052% | 0.051% |
| Vanadium | 0.014% | 0.012% | 0.013% |
| Manganese | 0.350% | 0.360% | 0.340% |
| Phosphorus | 0.004% | 0.003% | 0.003% |
| Sulfur | 0.004% | 0.004% | 0.005% |
| Silicon | 0.130% | 0.140% | 0.130% |
| Copper | 0.110% | 0.100% | 0.120% |
| 1" Sample Size | Substrate B (pre-fire) | | |
| Tensile Testing | 0.259 Diam. | 0.192 Diam. | 0.239 Diam. |
| Yield Strength | 88200 | 100300 | 98600 |
| Ultimate Strength | 89700 | 103400 | 102600 |
| % Elongation in 1" | 21 | 15 | 20 |
| % Reduction of Area | 71 | 67 | 67 |
| 1" Sample Size | Substrate B (post-fire) | | |
| Tensile Testing | 0.259 Diam. | 0.192 Diam. | 0.239 Diam. |
| Yield Strength | 57200 | 41400 | 51900 |
| Ultimate Strength | 71700 | 58100 | 70000 |
| % Elongation in 1" | 40% | 43% | 37 |
| % Reduction of Area | 77% | 80% | 79 |

PEMCO POWDER-1st Coat: GP2025, 2nd Coat: GP1124
Furnace Line Speed: 22 ft/mm (494 hangers/hour), 988 parts/hour
Washer Line Speed: 22 if/mm (494 hangers/hour), 988 parts/hour
4-10 mil thickness
1585F Zone 1 Temp.
1543F Zone 2 Temp.
25 minutes in furnace
10,000 lbs/hr maximum line capacity
Specific Gravity: 2.59
Buffing Process
Scotch-Brite Roloc surface conditioning disc Grade A MED
Disc sprayed with Wesson Liquid Oil The steel rod is then drawn in an area reduction process, preferably through a cold die, to reduce the diameter of the cross-sectional area, preferably at least about 20%, more preferably at least about 30%, more preferably at least about 35%, even more preferably about 40%, even more preferably about 45%, and most preferably about 50%, in order to incorporate cavities within the steel wire which allow hydrogen to be released into the cavities and also to reduce the diameter of the wire to that which is desired. The sheet on the following page gives the general specifications for non-iron elements and other aspects of the steel wire and the steel rod used to make the steel wire.

Once the steel rod is converted into wire in the wire drawing process, the steel wire is straight cut to predetermined lengths according to need. The various cut steel wire members are then formed as needed to provide the various parts of the coated oven rack. These parts are then welded together to form an oven rack substrate (not shown), for subsequent coating, in a standard welding operation. The oven racks are then cleaned in a washing process and then power acid washed with an electrically charged acid wash material to remove any remaining weld scale. The rack is then dried in an oven at about 500° F. and then air cooled. The clean oven rack is then sprayed with powdered glass in an electrostatic charged paint process in which the oven rack substrate is charged negatively and the glass powder is charged positively.

The spraying process is divided into a first coating process in which a first coat or a ground coat is placed upon the oven rack substrate. In preferred embodiments the first coat is a Pemco powder, GP2025 from Pemco. It will be appreciated that other similar or equivalent powders may also be used in alternate embodiments. After the first coat is applied a second coat or a top coat is applied. In preferred embodiments, this coat is a Pemco powder, GP1124, from Pemco. Again, it will be appreciated that other similar or equivalent powders may also be used in alternate embodiments. The coated oven rack substrate is then heated in an oven to about 1550° F. for about 25 minutes and then cooled. This coating and baking process is generally referred to as a double coat, single fire coating process. The coated oven racks are then cooled, buffed, preferably with a Scotch-Bright Robe surface conditioning disc grade A medium, sprayed with liquid oil, preferably Wesson liquid oil, and then packaged for shipping to the customer.

In an alternate process, the oven rack substrate is coated using a wet spray process, wherein the porcelain is coated onto the steel wire, in number of steps selected from each of five distinct wet coating processes including wet spray, electrostatic wet spray, wet flow coating, wet dip or electrophoretic deposition, or, more specific, as applied to porcelain, "EPE-Electro-porcelain enameling." This later process involves the use of a dip system where electric power is used to deposit porcelain enamel material on a metal surface. The wet coating processes can be single step, double step or multiple step processes followed by at least single or double heating process steps m which the temperature is preferably raised to about 1550 degrees F. or greater. In these processes, porcelain can be coated to steel by three basic methods of wet spraying by air atomization, hand spraying, automatic spraying and electrostatic spraying. When substrate is processed through a dipping operation, the part is immersed in the "slip", removed, and the slip is allowed to drain off. In flow coating, the slip is flowed over the part and the excess is allowed to drain off. Carefully controlled density of the porcelain enamel slip and proper positioning of the part is necessary to produce a uniform coating by dip or flow coat methods. Porcelain can be coated to steel by immersion or flow coating, as well, by five basic methods, hand dipping, tong dipping, automatic dip machines or systems, electrophoretic deposition systems and flow coating. It will be appreciated that any number of these various methods may be adapted for use within the broad general scope of the present invention.

It is to be understood, however, that even though numerous characteristics and advantages of the various embodiments of the present invention have been set forth in the foregoing description, together with details of the structure and function of the various embodiments of the present invention as shown in the attached drawings, this disclosure is illustrative only and changes may be made in detail, especially in manners of shape, size and arrangement of the parts, within the principles of the present invention, to the full extent indicated by the broad general meaning of the terms in which the appended claims are expressed.

What is claimed is:

1. A method of making a coated steel wire oven rack, comprising the steps of:

a) providing steel rod material containing from about 80 to about 99.9% by weight of iron, from about 0.001 to about 0.08% by weight of carbon and from about 0.001 to about 0.2% by weight of carbon stabilizing transition metal selected from the group consisting of Vanadium, Tantalum, Titanium and Niobium;

b) drawing the steel rod material to form steel wire, wherein the diameter of the cross-sectional area of the steel road material is reduced by at least about 20%;

c) forming a plurality of elongated steel wire members from said steel wire;

d) joining the plurality of steel wire members to one another to form interconnected parts of a steel wire oven rack; and e) coating the steel wire oven rack with porcelain.

2. The method in accordance with claim 1, wherein the step of coating includes two separate electrostatic coating steps in which a first ground coat of powdered glass is applied and then a second top coat of powdered glass is applied in a subsequent electrostatic coating application.

3. The method of claim 1, wherein the porcelain is coated onto the steel wire oven rack in a wet coating process selected from the group consisting of wet spray, electrostatic wet spray, wet flow coating, wet dip, electrophoretic deposition, and a combination thereof, followed by heating to a temperature of about 1550° F. or higher.

4. The method of claim 1, wherein the porcelain is coated onto the steel wire oven rack by an immersion or flow coating method selected from the group consisting of hand dipping, tong dipping, automatic dip machine coating, electrophoretic deposition, flow coating, and a combination thereof, followed by heating to a temperature of about 1550° F. or higher.

5. The method of claim 3, wherein the porcelain coated steel wire oven rack is heated to 1550° F. or higher for about 25 minutes prior to cooling.

6. The method of claim 4, wherein the porcelain coated steel wire oven rack is heated to 1550° F. or higher for about 25 minutes prior to cooling.

7. The method of claim 1, wherein the steel rod is repeatedly drawn in a cold die to gradually reduce the diameter of the steel rod at least about 20%.

8. The method of claim 1, wherein the steel rod comprises 0.046% to 0.051% carbon; and 0.012% to 0.014% transition metal, and wherein the rod is reduced in diameter 31% to 53%.

9. The method of claim 8, wherein the steel wire has a diameter in the range of 0.192 inch to 0.259 inch.

10. The method of claim 1, wherein the steel rod further includes 0.34% to 0.36% Mn; 0.003% to 0.004% P; 0.004% to 0.005% S; 0.130% to 0.140% Si; and 0.100% to 0.120% Cu, by weight.

11. The method of claim 10, wherein the steel rod includes iron in an amount in the range of 99.329% to 99.342% by weight.

* * * * *